US009459580B2

(12) United States Patent
Burnett

(10) Patent No.: US 9,459,580 B2
(45) Date of Patent: Oct. 4, 2016

(54) OPTICAL SENSOR WITH MULTIPLE DETECT MODES

(71) Applicant: XEROX CORPORATION, Norwalk, CT (US)

(72) Inventor: Daniel H. Burnett, Fairport, NY (US)

(73) Assignee: XEROX CORPORATION, Norwalk, CT (US)

( * ) Notice: Subject to any disclaimer, the term of this patent is extended or adjusted under 35 U.S.C. 154(b) by 357 days.

(21) Appl. No.: 14/176,648

(22) Filed: Feb. 10, 2014

(65) Prior Publication Data

US 2015/0227099 A1 Aug. 13, 2015

(51) Int. Cl.
*G03G 15/00* (2006.01)

(52) U.S. Cl.
CPC ..... *G03G 15/5062* (2013.01)

(58) Field of Classification Search
CPC ..... G03G 15/5062
USPC ..... 399/405, 45
See application file for complete search history.

(56) References Cited

U.S. PATENT DOCUMENTS 5,848,344 A 12/1998 Milillo et al.
6,055,060 A * 4/2000 Bolduan ..... G01N 21/8483 356/39
6,449,045 B1 9/2002 Mestha
7,529,493 B2 * 5/2009 Shiba ..... G03G 15/5029 399/45
7,555,396 B2 6/2009 Mestha et al.
7,889,344 B2 * 2/2011 Yamagishi ..... B65H 7/06 356/432
8,075,084 B2 12/2011 Ossman et al.
2005/0078973 A1 * 4/2005 Suzuki ..... B65H 7/14 399/45
2007/0165194 A1 * 7/2007 Jung ..... G02B 26/0833 353/99
2008/0056752 A1 * 3/2008 Denton ..... G03G 15/5062 399/74
2008/0253782 A1 * 10/2008 Honguh ..... G03G 15/5029 399/45
2010/0008684 A1 * 1/2010 Matsumoto ..... G03G 15/0822 399/45
2010/0150591 A1 * 6/2010 Yamashita ..... B41J 2/473 399/51
2011/0085213 A1 * 4/2011 Kim ..... H04N 1/4076 358/475

* cited by examiner

*Primary Examiner* — Anthony Nguyen
(74) *Attorney, Agent, or Firm* — MH2 Technology Law Group LLP

(57) ABSTRACT

An imaging apparatus including an imaging system and an optical sensor for detecting a print medium within a paper path. The optical sensor may include at least one light emitter and at least one light detector. The light detector is configured to output two or more light intensities sequentially onto the paper path, which reflects from the paper path or transmits directly onto the optical sensor. Data indicating an amount of light received by the at least one light detector is received by the controller, which performs data analysis to determine the presence or absence of a print medium in the paper path.

18 Claims, 2 Drawing Sheets

OPTICAL SENSOR WITH MULTIPLE DETECT MODES

TECHNICAL FIELD

The present teachings relate to the field of printing and copying devices and, more particularly, to methods and structures for detecting a print medium in a paper path of a printing or copying device.

BACKGROUND

Office systems such as printers and copiers require mechanical, electrical, and/or electromechanical assemblies for moving a print medium such as a paper sheet, a transparency, or other media such as magnetic or label transfer material, etc. (hereinafter, collectively, "paper") through a paper path and ensuring that the paper is properly aligned for printing or copying. These assemblies may include an optical sensor having a light emitter that emits light to illuminate the paper path and a light detector that detects light reflected from or blocked by the paper path. System software and/or firmware (hereinafter, collectively, "software") use information from the optical sensor to determine the presence or absence of a paper sheet in the paper path and, if present, a relative position of the paper within the paper path.

Light intensity output by the light emitter is calibrated for the particular office system design. The target light intensity should be sufficiently high so that the light detector correctly detects a paper sheet having a high percentage of dark printing. Further, the target light intensity should be sufficiently low to prevent reflection of light off of other machine elements in the absence of a paper sheet, which might be detected by the light detector and falsely interpreted by software as a paper sheet. Paper detection failure modes, including excessive and deficient light output by the light emitter, may also include contamination deposits on the optical sensor light path elements which may reduce light output by the emitter and light received by the detector, which adversely affects equipment operation. Additionally, component efficiency may degrade over time and reduce the detection of paper in the paper path. Contamination and reduction of component efficiency may require equipment servicing, and results in equipment down time and additional cost. Manufacturing tolerances on optical sensor components also affect the light output levels and resultant functionality.

An optical sensor that may overcome one or more deficiencies of conventional optical sensors would be desirable.

SUMMARY

The following presents a simplified summary in order to provide a basic understanding of some aspects of one or more embodiments of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later.

In a first embodiment, an imaging apparatus may include an imaging system comprising a print media path and an optical sensor. The optical sensor may include at least one light emitter, wherein the at least one light emitter is configured to output at least a first light intensity and a second light intensity that is higher than the first light intensity, at least one light detector, and a controller electrically coupled to the at least one light emitter and to the at least one light detector. Further, the controller may be configured to activate the at least one light emitter to selectively output the first light intensity and the second light intensity, and may be further configured to receive data from the at least one light detector, the data configured to enable the controller to compare an amount of light output from the at least one light emitter and received from the at least one light detector.

In another embodiment, a method for detecting a print medium within a paper path of an imaging apparatus may include outputting a first light intensity from at least one light emitter using a controller, receiving a portion of the first light intensity with at least one light detector, and outputting a second light intensity from the at least one light emitter using the controller, wherein the second light intensity is higher than the first light intensity. The method may further include receiving a portion of the second light intensity with the at least one light detector, and analyzing data regarding the first light intensity, the portion of the first light intensity received by the at least one light detector, the second light intensity, and the portion of the second light intensity received by the at least one light detector using the controller to determine the presence or absence of the print medium in the paper path.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

It should be noted that some details of the FIGS. have been simplified and are drawn to facilitate understanding of the present teachings rather than to maintain strict structural accuracy, detail, and scale.

DETAILED DESCRIPTION

Reference will now be made in detail to exemplary embodiments of the present teachings, examples of which are illustrated in the accompanying drawings. Wherever possible, the same reference numbers will be used throughout the drawings to refer to the same or like parts.

As used herein, unless otherwise specified, the word "printer" encompasses any apparatus that performs a print outputting function for any purpose, such as a digital copier, bookmaking machine, facsimile machine, a multi-function machine, electrostatographic (electrostatic-graphic) device, etc. In addition, the word "printer" encompasses the field of 3D printing where sequential buildup of materials takes place to form an object.

A system in accordance with the present teachings may include an optical sensor having a light emitter and a light detector. There are many possible arrangements of these optical sensors, for example the light emitter and the light detector can be in the same housing, and reflection from media would create a state change in the light detector. In an alternative, the light emitter and light detector could be in separate housings or arranged within one housing such that a blockage of light would create a state change in the light detector. The powering of the optical sensor can also be a steady voltage or varying in time, such as a short pulse, usually to increase light emitter (e.g., light emitting diodes, LED) life. By time shifting this power pulsing to include multiple sequential light intensity levels or adding dedicated control lines, software can deduce which output level was used and separate them functionally in an algorithm. Several implementation options exist including multiple light sources such as multiple LED's, multiple current limiting options on each LED, and multiple detectors each having a different sensitivity as described below. Each of these options may be employed in any of the previously mentioned reflective or blockage type optical sensors in either a single housing or multiple housings.

Figure 1:
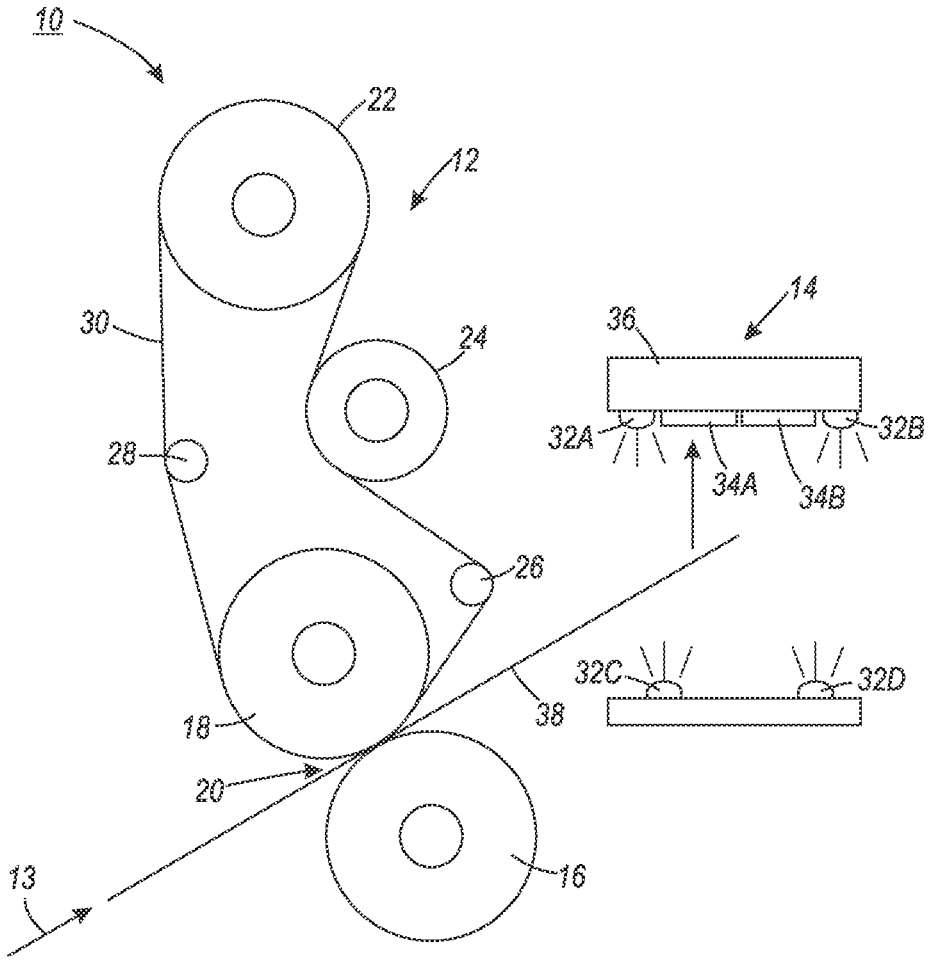
FIG. 1 is a schematic cross section of a printer including an optical sensor in accordance with an embodiment of the present teachings.

FIG. 1 depicts an imaging apparatus 10, for example a printer, including an imaging system 12 and an optical sensor 14. The imaging system 12 depicted in FIG. 1 may be any imaging system known in the art that includes a print media (e.g., paper) path 13. In this embodiment, imaging system 12 includes a pressure roll 16, a fuser roll 18, a nip 20, and various other rolls 22-28 that drive, provide tension for, and/or contact a fuser belt 30. Operation of the imaging system 12 is known in the art. The optical sensor 14 of FIG. 1 includes at least one light emitter 32 and at least one light detector 34. In an embodiment, two light emitters 32A, 32B and two light detectors 34A, 34B may be used in an embodiment that uses light reflection from the paper path 13 to determine the presence or absence of a print medium 38 in the paper path 13 (reflective embodiment). Each light emitter 32 and light detector 34 is electrically coupled to a controller 36 that controls operation of the light emitter 32 and receives data from the light detector 34. The controller 36 may be housed remotely from the optical sensor 14, for example in centralized control circuit boards (not individually depicted for simplicity). It is contemplated that partitioning of data collection and control elements may be embodied in one of many different forms.

In another embodiment, also depicted in FIG. 1 for simplicity, two light emitters 32C, 32D and two light detectors 34A, 34B may be used in an embodiment that uses light blockage by the paper path 13 to determine the presence or absence of a print medium 38 in the paper path (transmissive embodiment). While the embodiments are generally discussed below with regard to the reflective embodiment using light emitters 32A, 32B, it will be understood that the imaging apparatus 10 may function in a transmissive embodiment using light emitters 32C, 32D. In another embodiment, to improve detection, both reflective and transmissive light paths may be used in a single embodiment.

In the embodiment depicted in FIG. 1, light emitters 32A, 32B are configured to output different light intensities, for example where emitter 32A outputs a lower light intensity than emitter 32B. Further, light detectors 34A, 34B are configured for different light sensitivities, for example where light detector 34A is less sensitive to light than light detector 34B. During use, the optical sensor 14 may cycle through one or more operational modes, and may provide continuous operation during an imaging or printing cycle of the printer 10.

In a first operational mode, the controller 36 outputs a first signal to the first light emitter 32A, which thereby activates the first light emitter 32A, while the second light emitter 32B remains deactivated. Upon activation, the first light emitter 32A outputs a first light intensity onto the paper path 13. Light reflected from the paper path 13 is received by the one or more light detectors 34. Light reflected from the paper path 13 will be different depending on whether a print medium 38 is located in the paper path 13. Data relative to reflection of light emitted from the first light emitter 32A off of the paper path 13 and received by the light detectors 34 is received and stored by the controller 36.

Next, the controller 36 outputs a second signal to the second light emitter 32B, which thereby activates the second light emitter 32B while the first light emitter 32A remains deactivated. Upon activation, the second light emitter 32B outputs a second light intensity, different from the first light intensity, onto the paper path 13. Light reflected from the paper path 13 is received by the one or more light detectors 34. Data relative to reflection of light emitted from the second light emitter 34B off of the paper path 13 and received by the light detectors 34 is received and stored by the controller 36.

Subsequently, the controller 36 may output a third signal to activate both the first light emitter 32A and the second light emitter 32B at the same time, each of which thereby outputs respective light intensities onto the paper path 13. Light from both of the light emitters 32A, 32B, is reflected from the paper path 13 and received by the one or more light detectors 34. Data regarding an amount of light output from the light emitters 32A, 32B and reflected from the paper path 13 onto the one or more light detectors 34 is transmitted to, and received and stored by, the controller 36.

The data received by the controller 36 is analyzed using software stored within the controller 36 or another computational device to determine whether a print medium 38 is located within the paper path 13. Because more than one light intensity is used to generate the data, a more accurate determination may result compared to a system that uses a single light source outputting a single light intensity. Further, because two or more light detectors 34 may be used, the number of data points is further increased which improves accuracy in determining whether a print medium 38 is located within the paper path 13. In this embodiment, which includes two light emitters 32A, 32B, three light intensities, and two light detectors 34A, 34B, a total of six data points may be used for data analysis. Further, with two or more spaced light emitters 32, the controller firmware may analyze for stereoscopic data that would indicate light reflection from system components beyond the paper path 13 in the absence of a print medium 38, or that would indicate light reflection from a print medium 38 within the paper path 13, thereby reducing false positives.

In another embodiment, the optical sensor 14 may be constructed using a single light emitter 32 and/or a single light detector 34. In such an embodiment, the controller 36 may output a varying signal, voltage, and/or current to the light emitter 32 to vary the light intensity output by the light emitter 32. Further, the controller 36 may output a signal, voltage, and/or current that causes a change in the sensitivity of the light detector 34. In an embodiment with a single light detector 34, the stereoscopic advantages realized with the embodiment discussed above, or other embodiments including two or more light detectors, may not be available. Further, varying voltage and/or current to change the light output by the light emitter 34 may allow for a wider range of light output intensities.

Figure 2:
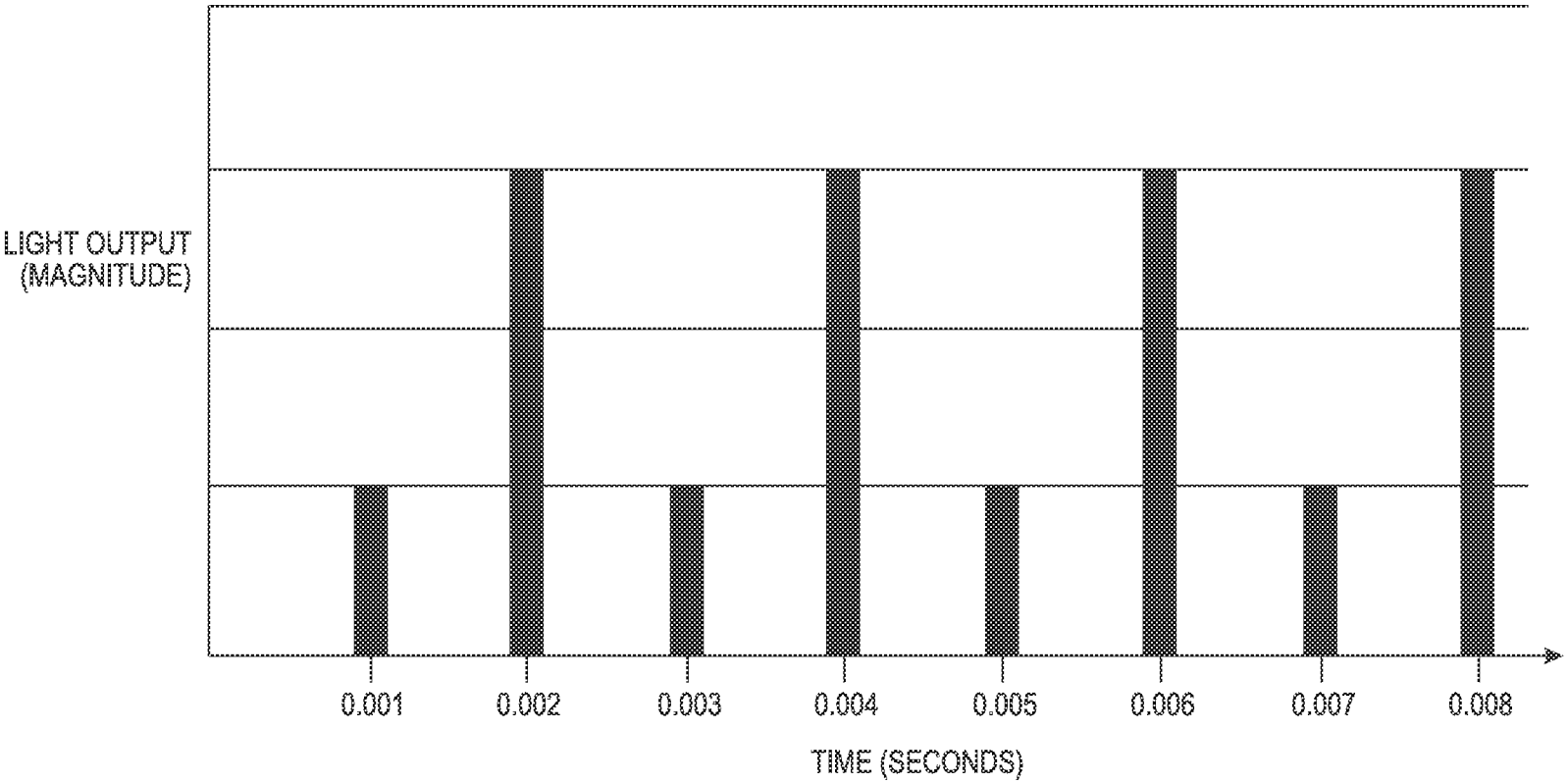
FIG. 2 is a chart depicting an operating mode of an optical sensor in accordance with an embodiment of the present teachings.

FIG. 2 is a chart depicting a plurality of cycles according to an embodiment of the present teachings. This embodiment includes two magnitudes of light output using an operational mode that continuously cycles between a low light intensity output and a high light intensity output by the light emitter 32. During a detection mode, the system may alternate between a low light level strobe and a high light level strobe during a plurality of cycles. In another embodiment, a system may include the use of a low light output for job runs using print media with a high reflectance and a high light output for job runs using print media with a low reflectance.

Outputting more than one light level using one, or more than one, light emitter may increase accuracy of print medium detection through analysis of reflected light detection. This analysis may allow for improved print medium detection over an operational life of the printer during wear out or contamination build-up of the light emitter. For example, self-test or self-calibration circuitry within the controller 36 may perform routine maintenance self-checks to determine the amount of light output by the light emitter compared to the amount of light received by the light detector. If the light received by the light detector is less than a threshold value, the controller may increase the voltage and/or current to the light emitter such that the light received by the light detector is above the threshold value.

In embodiments including redundant light emitters and/or redundant light detectors, the redundant component may continue to operate sufficiently even though another component has failed. By time shifting the power pulsing to include multiple levels or adding dedicated control lines, software can deduce which output level was used, and separate the levels functionally in an algorithm. Several implementation options exist as described above, including multiple LED's, multiple current limiting options on each LED, and multiple detectors.

An embodiment of the present teachings includes an optical sensor having multiple sensitivity levels that may be called upon based on a particular application or situation. The light output may be changed within a particular system based on, for example, media type within the paper path or the job run. For example, a darker media having a low light reflectance used for a first job run in an imaging system may require a higher light intensity or higher average light intensity, while a lighter media having a high light reflectance used for a second job run in the imaging system may require a lower light intensity or lower average light intensity. Similarly, for transmissive optical sensors that derive their signals from a blockage of light from light emitters 32C, 32D rather than a reflectance of light from light emitters 32A, 32B, a change in distance over which a sensor needs to respond would benefit from a change in the light intensity.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. For example, it will be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It will be appreciated that structural components and/or processing stages can be added or existing structural components and/or processing stages can be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the workpiece, regardless of the orientation of the workpiece.

The invention claimed is:

1. An imaging apparatus, comprising:

an imaging system comprising a print media path;

an optical sensor, comprising:

at least one light emitter, wherein the at least one light emitter is configured to output at least a first light intensity and a second light intensity that is higher than the first light intensity during an imaging or printing cycle;

at least one light detector; and a controller electrically coupled to the at least one light emitter and to the at least one light detector, wherein:

the controller is configured to activate the at least one light emitter to selectively output the first light intensity and the second light intensity;

the controller is further configured to receive data from the at least one light detector, the data configured to enable the controller to compare an amount of light output from the at least one light emitter and received from the at least one light detector;

the controller is further configured to perform a self-check on the imaging system to determine an amount of light output by the at least one light emitter by comparing an amount of light received from the at least one light emitter by the at least one light detector during the self-check to a threshold value; and the controller is further configured to increase at least one of a voltage and a current to the at least one light emitter during the imaging or printing cycle in response to the amount of light received by the at least one light detector being below the threshold value to increase the amount of light output by the at least one light emitter during the printing or imaging cycle.

2. The imaging apparatus of claim 1, wherein the optical sensor further comprises a first light emitter outputting the first light intensity and a second light emitter outputting the second light intensity.

3. The imaging apparatus of claim 2, wherein the controller is further configured to activate the first light emitter while the second light emitter remains deactivated, and to activate the second light emitter while the first light emitter remains deactivated.

4. The imaging apparatus of claim 3, wherein the controller is further configured to activate the first light emitter and the second light emitter at the same time.

5. The imaging apparatus of claim 1, wherein the optical sensor further comprises only one light emitter, wherein the controller is further configured to vary at least one of the voltage and the current over time to the only one light emitter, thereby varying a light intensity output by the only one light emitter during the imaging or printing cycle.

6. The imaging apparatus of claim 1, wherein the optical sensor further comprises a first light detector having a first sensitivity to light and a second light detector having a second sensitivity to light which is greater than the first sensitivity.

7. The imaging apparatus of claim 1, wherein the optical sensor further comprises only one light detector, wherein the controller is further configured to vary at least one of a voltage and a current over time to the only one light detector, thereby varying a light sensitivity of the only one light detector.

8. The imaging apparatus of claim 1, wherein:

the print media path is interposed between the at least one light emitter and the at least one light detector;

in the absence of a print media in the paper path, the at least one light detector receives a third light intensity; and in the presence of a print media in the paper path, the at least one light detector receives a fourth light intensity, where the third light intensity is higher than the fourth light intensity.

9. The imaging apparatus of claim 1, wherein:

the at least one light emitter and the at least one light detector are located on a same side of the paper path;

in the absence of a print media in the paper path, the light detector receives a third light intensity; and in the presence of a print media in the paper path, the light detector receives a fourth light intensity, where the third light intensity is higher than the fourth light intensity.

10. A method for detecting a print medium within a paper path of an imaging apparatus, comprising:

outputting a first light intensity from at least one light emitter using a controller during an imaging or printing cycle;

receiving a portion of the first light intensity with at least one light detector;

outputting a second light intensity from the at least one light emitter using the controller, wherein the second light intensity is higher than the first light intensity;

receiving a portion of the second light intensity with the at least one light detector;

analyzing data regarding the first light intensity, the portion of the first light intensity received by the at least one light detector, the second light intensity, and the portion of the second light intensity received by the at least one light detector using the controller to determine the presence or absence of the print medium in the paper path; and performing a self-check on the imaging apparatus, wherein the self-check comprises:

determining an amount of light output by the at least one light emitter by comparing an amount of light received from the at least one light emitter by the at least one light detector during the self check to a threshold value; and responsive to the amount of light received by the at least one detector during the self-check being below the threshold value, increasing at least one of an input voltage and an input current to the at least one light emitter during the imaging or printing cycle to increase the amount of light output during the imaging or printing cycle.

11. The method of claim 10, further comprising:

outputting the first light intensity from a first light emitter; and outputting the second light intensity using a second light emitter.

12. The method of claim 11, further comprising:

activating the first light emitter during deactivation of the second light emitter; and activating the second light emitter during deactivation of the first light emitter.

13. The method of claim 12, further comprising activating the first light emitter and the second light emitter at the same time.

14. The method of claim 10 where the at least one light emitter is only one light emitter and the method further comprises varying at least one of the input voltage and the input current over time to the only one light emitter to vary a light intensity output by the only one light emitter.

15. The method of claim 10, where the at least one light detector comprises a first light detector having a first sensitivity to light and a second light detector having a second sensitivity to light which is greater than the first sensitivity.

16. The method claim 10, wherein the at least one light detector is only one light detector and the method further comprises varying at least one of a voltage and a current over time to the only one light detector, thereby varying a light sensitivity of the only one light detector.

17. The method of claim 10 wherein the print media path is interposed between the at least one light emitter and the at least one light detector, and the method further comprises:

in the absence of a print media in the paper path, receiving a third light intensity by the at least one light detector; and in the presence of a print media in the paper path, receiving a fourth light intensity by the at least one light detector, where the third light intensity is higher than the fourth light intensity.

18. The method of claim 10 wherein the at least one light emitter and the at least one light detector are located on a same side of the paper path, and the method further comprises:

in the absence of a print media in the paper path, receiving a third light intensity by the at least one light detector; and in the presence of a print media in the paper path, receiving a fourth light intensity by the at least one light detector, where the third light intensity is higher than the fourth light intensity.

* * * * *